US010041501B2

(12) United States Patent
Torii et al.

(10) Patent No.: US 10,041,501 B2
(45) Date of Patent: Aug. 7, 2018

(54) VORTEX PUMP AND FUEL VAPOR TREATMENT DEVICE COMPRISING THE VORTEX PUMP

(71) Applicant: AISAN KOGYO KABUSHIKI KAISHA, Obu-shi (JP)

(72) Inventors: Hidemasa Torii, Anjo (JP); Atsushi Sugimoto, Obu (JP); Shinya Suzuki, Obu (JP)

(73) Assignee: AISAN KOGYO KABUSHIKI KAISHA, Obu-Shi (JP)

( * ) Notice: Subject to any disclaimer, the term of this patent is extended or adjusted under 35 U.S.C. 154(b) by 0 days.

(21) Appl. No.: 15/481,719

(22) Filed: Apr. 7, 2017

(65) Prior Publication Data

US 2017/0298949 A1 Oct. 19, 2017

(30) Foreign Application Priority Data

Apr. 13, 2016 (JP) ..... 2016-080563

(51) Int. Cl.

| | |
|---|---|
| ***F02M 25/08*** | (2006.01) |
| ***F04D 29/18*** | (2006.01) |
| ***F04D 29/22*** | (2006.01) |
| *F04D 23/00* | (2006.01) |
| *F04D 5/00* | (2006.01) |

(52) U.S. Cl.

CPC ..... *F04D 29/188* (2013.01); *F04D 29/2244* (2013.01); *F04D 5/00* (2013.01); *F04D 23/008* (2013.01)

(58) Field of Classification Search

CPC ..... F04D 29/188; F04D 29/2244; F04D 5/00; F04D 23/008; F02M 25/0836; F02M 25/089

USPC ..... 123/516, 518, 519, 520

See application file for complete search history.

(56) References Cited

U.S. PATENT DOCUMENTS 4,508,492 A 4/1985 Kusakawa et al.
5,586,858 A * 12/1996 Tuckey ..... F02M 37/08 415/55.1
6,068,456 A * 5/2000 Tuckey ..... F02M 37/048 417/423.3

(Continued)

FOREIGN PATENT DOCUMENTS

JP S50-103236 U1 8/1975
JP S58-101263 A 6/1983

(Continued)

*Primary Examiner* — Hai Huynh

(74) *Attorney, Agent, or Firm* — Shumaker, Loop & Kendrick, LLP

(57) ABSTRACT

A vortex pump may include a motor portion and a pump portion. The pump portion includes an impeller that rotates integrally with an output shaft of a motor. The motor portion and the pump portion are separated by a separation wall. A vane-groove region including vane grooves is provided on a surface of the impeller facing the separation wall. The separation wall includes a facing groove facing the vane-groove region and extending along a rotation direction of the impeller. A communication hole that communicates the motor portion and the pump portion is provided on the facing groove. The communication hole extends in a direction along swirling flow formed by the vane grooves and the facing groove when the vortex pump is operating.

6 Claims, 8 Drawing Sheets

(56) References Cited

U.S. PATENT DOCUMENTS

| | | | | |
|---|---|---|---|---|
| 6,231,318 | B1 * | 5/2001 | Cotton | B01D 35/027 123/509 |
| 7,575,410 | B2 * | 8/2009 | Uchida | F01N 3/22 415/36 |
| 2003/0231953 | A1 * | 12/2003 | Ross | F04D 5/005 415/55.1 |
| 2006/0024176 | A1 | 2/2006 | Ikeya | |
| 2007/0077138 | A1 * | 4/2007 | Tsuzuki | F04D 29/188 415/55.1 |

FOREIGN PATENT DOCUMENTS

| | | | | | |
|---|---|---|---|---|---|
| JP | S62-008392 | U1 | | 1/1987 | |
| JP | H1-174591 | U1 | | 12/1989 | |
| JP | H1-313668 | A | | 12/1989 | |
| JP | H5-321865 | A | | 12/1993 | |
| JP | 2006-037870 | A | | 2/2006 | |
| JP | 2017-190720 | | * | 10/2017 | F04D 5/00 |
| WO | WO 2017/090510 | A1 | * | 6/2017 | F04D 23/00 |

* cited by examiner

VORTEX PUMP AND FUEL VAPOR TREATMENT DEVICE COMPRISING THE VORTEX PUMP

TECHNICAL FIELD

The disclosure herein relates to a technique related to a vortex pump. Further, the disclosure relates also to a technique related to a fuel vapor treatment device provided with the aforementioned vortex pump, and that supplies fuel vapor generated in a fuel pump to an intake passage of an internal combustion engine and treats the same.

BACKGROUND

Japanese Patent Application Publication No. 2006-37870 (hereinbelow referred to as Patent Literature 1) describes a vortex pump provided with a motor portion and a pump portion. The motor portion and the pump portion are provided in a housing. The housing is provided with a separation wall that separates the motor portion and the pump portion. Further, the housing has a bearing fixed thereon for supporting an output shaft of a motor. The output shaft of the motor extends from the motor portion to the pump portion in a state of being supported by the bearing. The pump portion is provided with a fluid suction port, a fluid discharge port, and an impeller. A vane-groove region configured of a plurality of vane grooves is provided on an outer periphery of the impeller. Further, a facing groove is provided on the separation wall at a position facing the vane-groove region. In Patent Literature 1, a communication hole communicating the motor portion and the pump portion is provided at a bottom of the separation wall.

SUMMARY

The vortex pump pressurizes and discharges fluid that has been sucked in by using rotation of the impeller. Due to this, a pressure difference is generated between the motor portion and the pump portion when the vortex pump operates (when the impeller rotates). For example, when a pressure of the pump portion becomes higher than a pressure of the motor portion, the fluid moves from the pump portion to the motor portion through the communication hole. In the vortex pump, the fluid is pressurized by generating a rotating flow (swirling flow) between the vane grooves and the facing groove.

According to studies conducted by the inventors, it has been found that in the vortex pump, a phenomenon in which the fluid cannot flow smoothly through the communication hole due to an influence of the rotating flow occurs merely by providing the communication hole at the bottom of the facing groove. In such a case, the fluid flows from the pump portion to the motor portion to compensate the pressure difference through gaps in the bearing. As a result, the bearing may be deteriorated by foreign particles or the like contained in the fluid. In the present description, a technique that appropriately reduces a pressure difference between a motor portion and a pump portion is provided.

The disclosure herein may provide a vortex pump comprising a housing, wherein the housing comprises: a motor portion comprising a motor; a pump portion comprising a fluid suction port, a fluid discharge port, and an impeller configured to rotate together with an output shaft of the motor; and a separation wall comprising a bearing fixed to the separation wall and separating the motor portion and the pump portion, the bearing supporting the output shaft;

wherein the impeller comprises a vane-groove region at an outer periphery of a surface of the impeller facing the separation wall along a rotation direction in which the impeller rotates, the vane-groove region including a plurality of vanes and a plurality of vane grooves, each of which is disposed between the adjacent vanes, and the separation wall comprises a facing groove facing the vane-groove region, extending in the rotation direction of the impeller, and having a bottom provided with a communication hole for communicating the motor portion and the pump portion, and wherein the communication hole extends in a direction along swirling flow formed by the vane grooves and the facing groove when the vortex pump is operating.

In the above vortex pump, the communication hole is provided along the swirling flow. This allows the fluid to pass easily through the communication hole, and when a pressure difference is generated between the motor portion and the pump portion during the operation of the vortex pump, the fluid flows through the communication hole instead of passing through gaps in the bearing. Deterioration of the bearing can be suppressed.

The disclosure herein may further provide a fuel vapor treatment device comprising: a canister that absorbs fuel vapor generated in a fuel tank; a purge passage connected between an intake passage of an internal combustion engine and the canister, and through which purge gas fed from the canister to the internal combustion engine passes; and the vortex pump as aforementioned and provided on the purge passage between the canister and the intake passage, wherein a size of the communication hole provided in the vortex pump is larger than a size of apertures of a filter provided on the canister.

In the above fuel vapor treatment device, the vortex pump pressurizes the gas containing the fuel vapor absorbed in the canister (purge gas) and feeds the same toward the intake passage. By making the size of the communication hole larger than the size of each of the apertures (aperture size) of the filter provided in the canister, foreign particles that had passed through the filter of the canister can be prevented from clogging the communication hole. An opening of the communication hole can be ensured to maintain opened, and the bearing supporting the output shaft of the motor of the vortex pump can be suppressed from becoming deteriorated.

DETAILED DESCRIPTION

Figure 1:
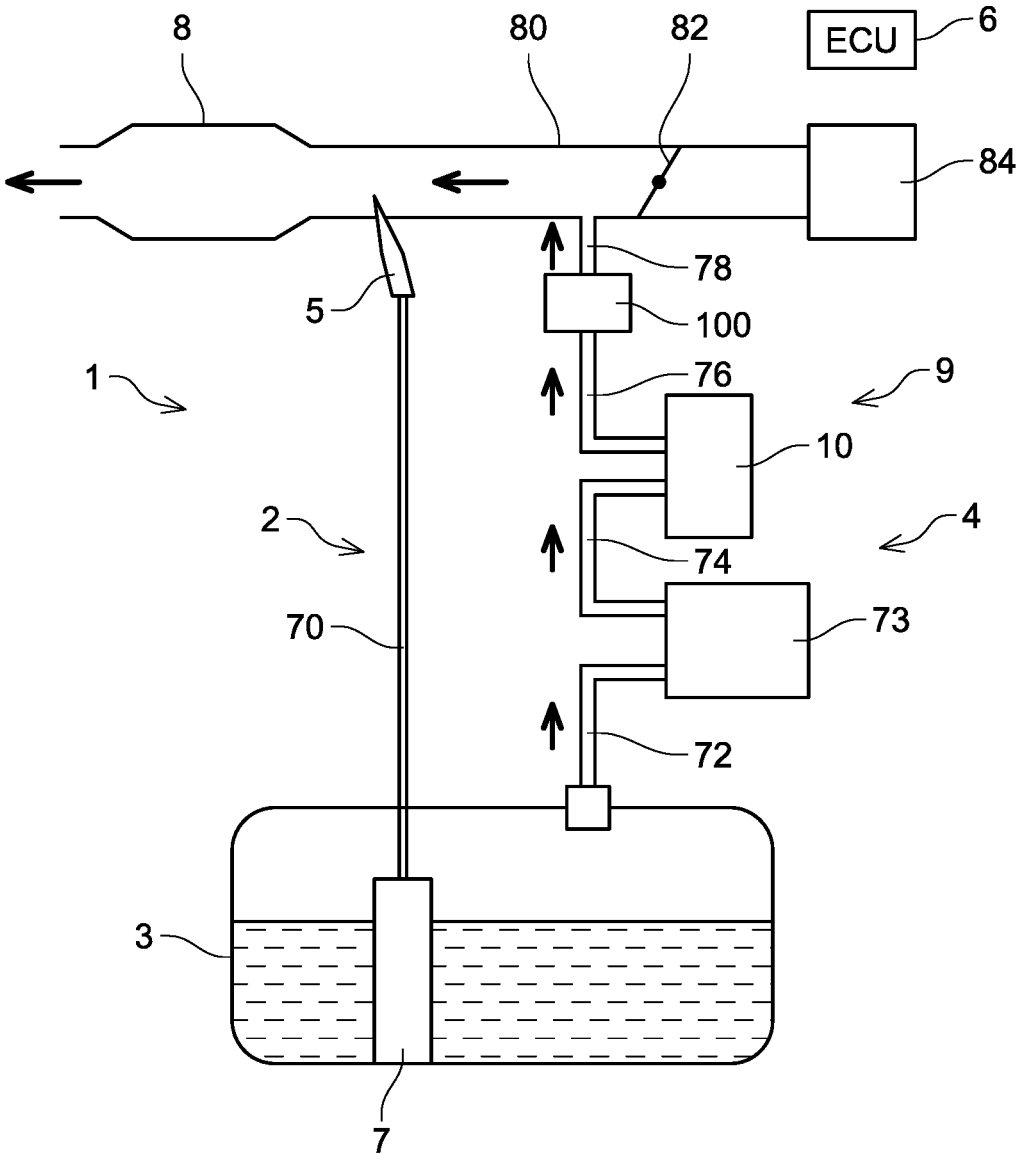
FIG. 1 shows a fuel supply system using a fuel vapor treatment device.

Some of the features characteristic to below-described embodiments will herein be listed. It should be noted that the respective technical elements are independent of one another, and are useful solely or in combinations.

A fuel vapor treatment device comprises a canister, a purge passage, and a vortex pump. The canister absorbs fuel vapor generated in a fuel tank. The purge passage is connected between an intake passage of an internal combustion engine and the canister. Purge gas sent from the canister to the internal combustion engine passes through the purge passage. A fuel vapor treatment device may be provided with a control valve that controls a supply amount of the purge gas to the intake passage. The vortex pump may be provided on the purge passage between the canister and the control valve. The canister may be provided with a filter for preventing foreign particles from entering to the purge passage.

A vortex pump comprises a motor portion and a pump portion. The motor portion and the pump portion may be provided in a housing of the vortex pump. The motor portion and the pump portion may be separated by a separation wall provided in the housing. In other words, the motor portion and the pump portion may be arranged in different spaces that are partitioned by the separation wall. The motor portion comprises a motor. The pump portion comprises a fluid suction port, a fluid discharge port, and an impeller. The impeller may be connected to an output shaft of the motor, and may rotate integrally with the output shaft. The output shaft may be supported on a bearing fixed to the separation wall.

A vane-groove region may be provided along a rotation direction of the impeller on an outer periphery of a surface of the impeller facing the separation wall. Notably, the rotation direction of the impeller is included in a plane that orthogonally intersects a rotation shaft direction of the impeller (rotation shaft direction of the output shaft). The vane-groove region may comprise a plurality of vanes, and vane grooves, each of which is disposed between the adjacent vanes. The vane-groove region may be provided on each of both surfaces (front and rear surfaces) of the impeller in the rotation shaft direction. That is, the vane-groove region may be provided on the surface of the impeller facing the separation wall, and also on the opposite surface thereof. The separation wall may comprise a facing groove on its surface facing the vane-groove region. The facing groove may extend along the rotation direction of the impeller. Further, another facing groove facing the vane-groove region may be provided along the rotation shaft direction on the housing on an opposite side of the separation wall relative to the impeller.

A communication hole communicating the motor portion and the pump portion may be provided at a bottom of the facing groove provided on the separation wall. The communication hole may extend in a direction that is along swirling flow that is to be formed by the vane grooves and the facing groove when the vortex pump is operating. An opening of the communication hole on a pump portion side may be located radially outside than the opening of the communication hole on a motor portion side. A radial direction herein refers to a direction that orthogonally intersects with a rotation shaft of the impeller. In other words, the communication hole may extend such that it extends towards the rotation shaft of the impeller from the pump portion side toward the motor portion side. The communication hole may be inclined relative to the rotation shaft of the impeller.

The communication hole may be provided in the facing groove on a suction port side, and another communication hole may be provided on a discharge port side. When the vortex pump is operating, a pressure in the pump portion is biased to be higher on the discharge port side than on the suction port side. Due to this, a flow in which the fluid flows from the pump portion to the motor portion through the communication hole provided on the discharge port side, and the fluid further flows from the motor portion to the pump portion through the communication hole provided on the suction port side can thereby be established. The fluid can be prevented from flowing through gaps between the bearing (for example, gaps between an inner race and an outer race). In this case, a filter may be provided on the communication hole on the discharge port side. Foreign particles contained in the fluid can be prevented from entering into the motor portion.

The communication hole may be provided at the bottom of the facing groove at a position where a pressure equivalent to a pressure applied to the bearing when the vortex pump is operating is applied. In this case, there may only be one communication hole. The fluid can be prevented from flowing through the gaps of the bearing when the pressures on an inlet side (e.g., the pump portion side) and an outlet side (e.g., the motor portion side) of the communication hole are balanced (the fluid moving from the pump portion side to the motor portion side, or from the motor portion side to the pump portion side). Notably, when the vortex pump is to be used in the fuel vapor treatment device as aforementioned, a size of the communication hole may be greater than a size of apertures (aperture size) of the filter provided on the canister. Clogging of the communication hole can be prevented.

EMBODIMENTS

A fuel supply system 1 provided with a purge pump 10 will be described with reference to FIGS. 1 and 2. As shown in FIG. 1, the fuel supply system 1 includes a main supply passage 2 and a purge supply passage 4 for supplying fuel from a fuel tank 3 to an engine 8.

The main supply passage 2 has a fuel pump unit 7, a supply pipe 70, and an injector 5 provided thereon. The fuel pump unit 7 is provided with a fuel pump, a pressure regulator, a control circuit, and the like. In the fuel pump unit 7, the control circuit controls the fuel pump according to signals supplied from an ECU (Engine Control Unit) 6 to be described later. The fuel pump pressurizes the fuel in the fuel tank 3 and discharges the same. The fuel discharged from the fuel pump has its pressure regulated by the pressure regulator, and thereafter is supplied from the fuel pump unit 7 to the supply pipe 70.

The supply pipe 70 communicates the fuel pump unit 7 and the injector 5. The fuel supplied to the supply pipe 70 flows within the supply pipe 70 to the injector 5. The injector 5 has a valve of which divergence is controlled by the ECU 6. When the valve is opened, the injector 5 supplies the fuel supplied from the supply pipe 70 to the engine 8.

The purge supply passage 4 has a fuel vapor treatment device 9 provided therein. The fuel vapor treatment device 9 includes a canister 73, a purge pump 10, a control valve 100, and communicating pipes 74, 76, 78 that communicate the aforementioned components. The communicating pipes 74, 76, 78 are connected between the canister 73 and an air intake pipe 80, and configure a passage for purge gas (purge passage). Although details thereof will be described in detail later, the purge pump 10 is a vortex pump that pressurizes and feeds fluid (gas). Notably, the vortex pump may be called a Wesco pump, a cascade pump, or a regeneration pump. The canister 73 absorbs fuel vapor generated in the fuel tank 3. FIG. 1 shows a gas flow direction from the fuel tank 3 to the air intake pipe 80 by arrows. A tank port of the fuel tank 3 is connected to a communicating pipe 72 extending from an upper end of the fuel tank 3. The canister 73 and the fuel tank 3 are communicated by the communicating pipe 72. The air intake pipe 80 is an example of an intake passage as recited in the Claims.

Figure 2:
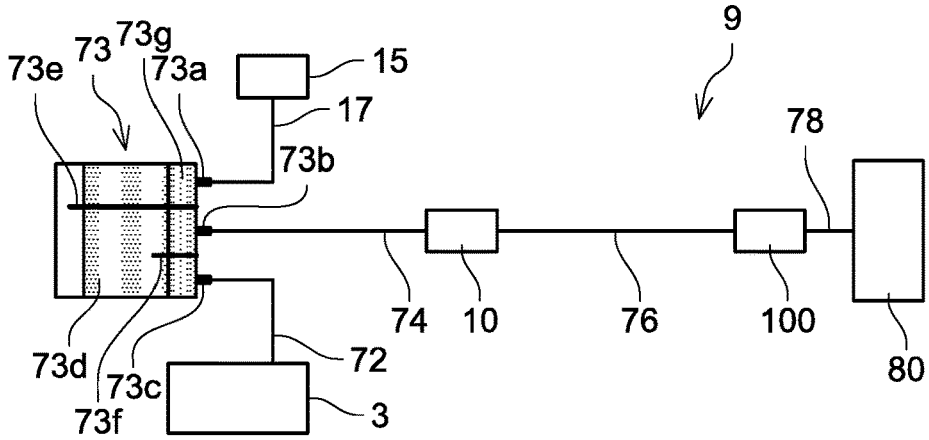
FIG. 2 shows a schematic diagram of the fuel vapor treatment device.

As shown in FIG. 2, the canister 73 is provided with an atmospheric port 73*a*, a purge port 73*b*, and a tank port 73*c*. The atmospheric port 73*a* is connected to an air filter 15 via a communicating pipe 17. The purge port 73*b* is connected to the communicating pipe 74. The tank port 73*c* is connected to the fuel tank 3 via the communicating pipe 72. An activated charcoal 73*d* is housed in the canister 73. The ports 73*a*, 73*b*, and 73*c* are provided on one wall surface facing the activated charcoal 73*d* among wall surfaces of the canister 73. A space is provided between the activated charcoal 73*d* and an inner wall of the canister 73 where the ports 73*a*, 73*b*, and 73*c* are provided. A filter 73*g* is provided in the space. Further, a first separator 73*e* and a second separator 73*f* are fixed to the inner wall of the canister 73 where the ports 73*a*, 73*b*, and 73*c* are provided. The first separator 73*e* separates the space between the activated charcoal 73*d* and the inner wall of the canister 73 at a position between the atmospheric port 73*a* and the purge port 73*b*. The first separator 73*e* extends to a space on an opposite side from where the ports 73*a*, 73*b*, and 73*c* are provided. The second separator 73*f* separates the space between the activated charcoal 73*d* and the inner wall of the canister 73 at a position between the purge port 73*b* and the tank port 73*c*.

The activated charcoal 73*d* absorbs the fuel vapor from the gas flowing into the canister 73 from the fuel tank 3 through the communicating pipe 72 and the tank port 73*c*. The gas from which the fuel vapor has been absorbed is discharged to atmosphere through the atmospheric port 73*a*, the communicating pipe 17, and the air filter 15. The canister 73 can prevent the fuel vapor inside the fuel tank 3 from being discharged into the atmosphere in a large amount. The fuel vapor absorbed by the activated charcoal 73*d* is supplied to the communicating pipe 74 from the purge port 73*b*. The communicating pipe 74 is supplied with the fuel vapor (purge gas) from which foreign particles have been removed by the filter 73*g*. The first separator 73*e* separates a space where the atmospheric port 73*a* is connected and a space where the purge port 73*b* is connected. The first separator 73*e* prevents the gas containing fuel vapor from being discharged into the atmosphere in a large amount. The second separator 73*f* separates the space where the purge port 73*b* is connected and a space where the tank port 73*c* is connected. The second separator 73*f* prevents the gas flowing into the canister 73 from the tank port 73*c* to flow directly to the communicating pipe 74.

The purge port 73*b* of the canister 73 is connected to the purge pump 10 via the communicating pipe 74. The purge pump 10 is controlled by the ECU 6. The purge pump 10 sucks in the fuel vapor absorbed in the canister 73, and pressurizes and discharges it. During when the purge pump 10 is operating, air is sucked into the canister 73 from the atmospheric port 73*a*, and the air flows into the purge pump 10 together with the fuel pump absorbed by the activated charcoal 73*d*. The purge gas discharged from the purge pump 10 passes through the communicating pipe 76, the control valve 100, and the communicating pipe 78, and flows into the air intake pipe 80. The control valve 100 is a solenoid valve controlled by the ECU 6. The ECU 6 adjusts a purge gas amount (purge amount) to be supplied to the air intake pipe 80 by controlling the control valve 100.

As shown in FIG. 1, the communicating pipe 78 (a part of the purge passage) is connected to the air intake pipe 80 on an upstream side of the injector 5. The air intake pipe 80 is a pipe for supplying air to the engine 8. A throttle valve 82 is provided on the air intake pipe 80 on an upstream side of a position where the communicating pipe 78 is connected. The throttle valve 82 adjusts air flowing into the engine 8 by controlling divergence of the air intake pipe 80. The throttle valve 82 is controlled by the ECU 6.

An air cleaner 84 is arranged on the air intake pipe 80 on an upstream side of the throttle valve 82. The air cleaner 84 includes a filter for removing foreign particles from the air flowing into the air intake pipe 80. The air intake pipe 80 sucks air in from the air cleaner 84 towards the engine 8 when the throttle valve 82 is opened. The engine 8 uses the air from the air intake pipe 80 and the fuel for its internal combustion, and discharges them after the combustion.

In the fuel vapor treatment device 9, the fuel vapor absorbed in the canister 73 can be supplied to the air intake pipe 80 by the operation of the purge pump 10. When the engine 8 is running, a negative pressure is generated in the air intake pipe 80. Due to this, even during when the purge pump 10 is in a halted state, the fuel vapor absorbed in the canister 73 is supplied to the air intake pipe 80 by passing through the halted purge pump 10 by the negative pressure in the air intake pipe 80. On the other hand, in cases where idling of the engine 8 is stopped during when a vehicle is stopped, or where the engine 8 is stopped to run on a motor such as in a hybrid vehicle, that is, in cases where the operation of the engine 8 is to be limited for eco-driving purposes or functions, there may be a situation where the inside of the air intake pipe 80 does not have a negative pressure. Further, if a supercharger is to be mounted, there may be a situation where the inside of the air intake pipe 80 has a positive pressure. The purge pump 10 can supply the fuel vapor absorbed in the canister 73 to the air intake pipe 80 even under such situations. Notably, the purge pump 10 may be operated to supply the purge gas to the air intake pipe 80 even in a situation where the engine 8 is running and a negative pressure is generated in the air intake pipe 80, if an absolute value of the negative pressure is small.

Figure 3:
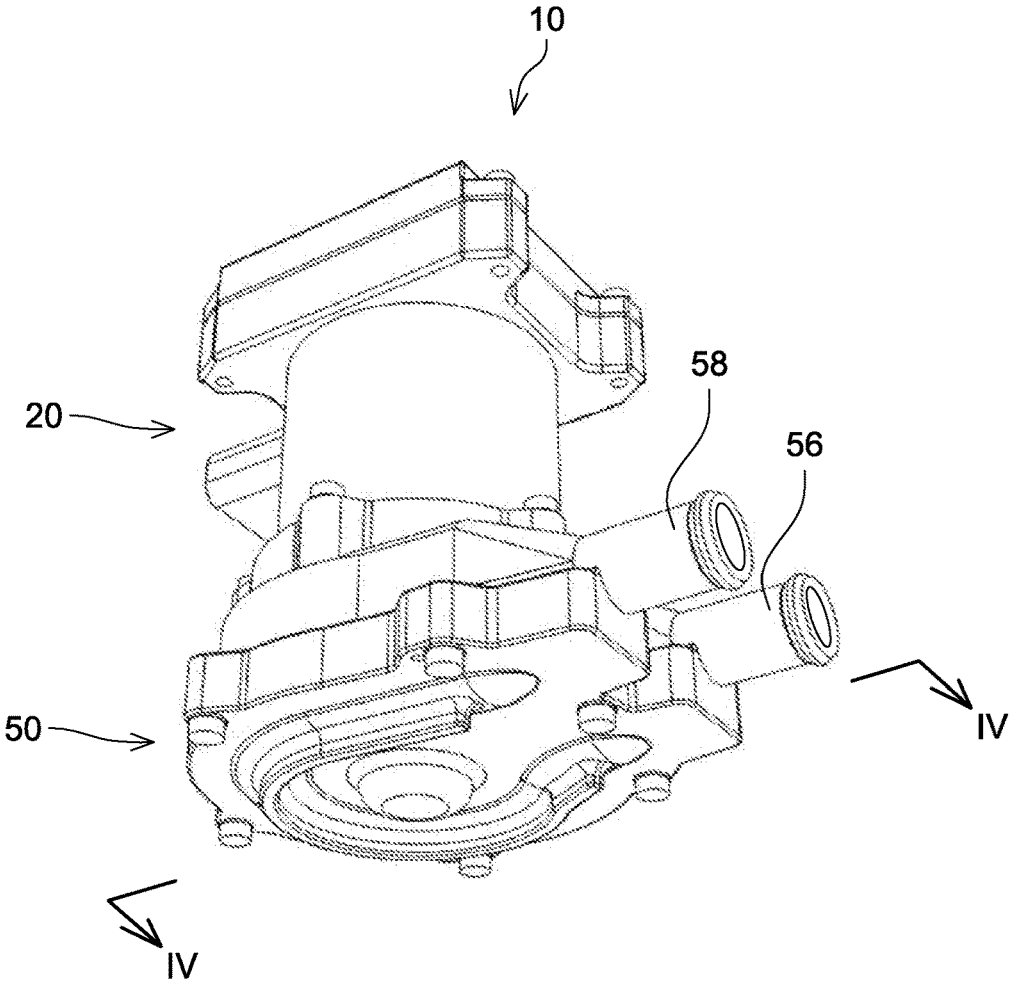
FIG. 3 shows a perspective view of a purge pump.
Figure 4:
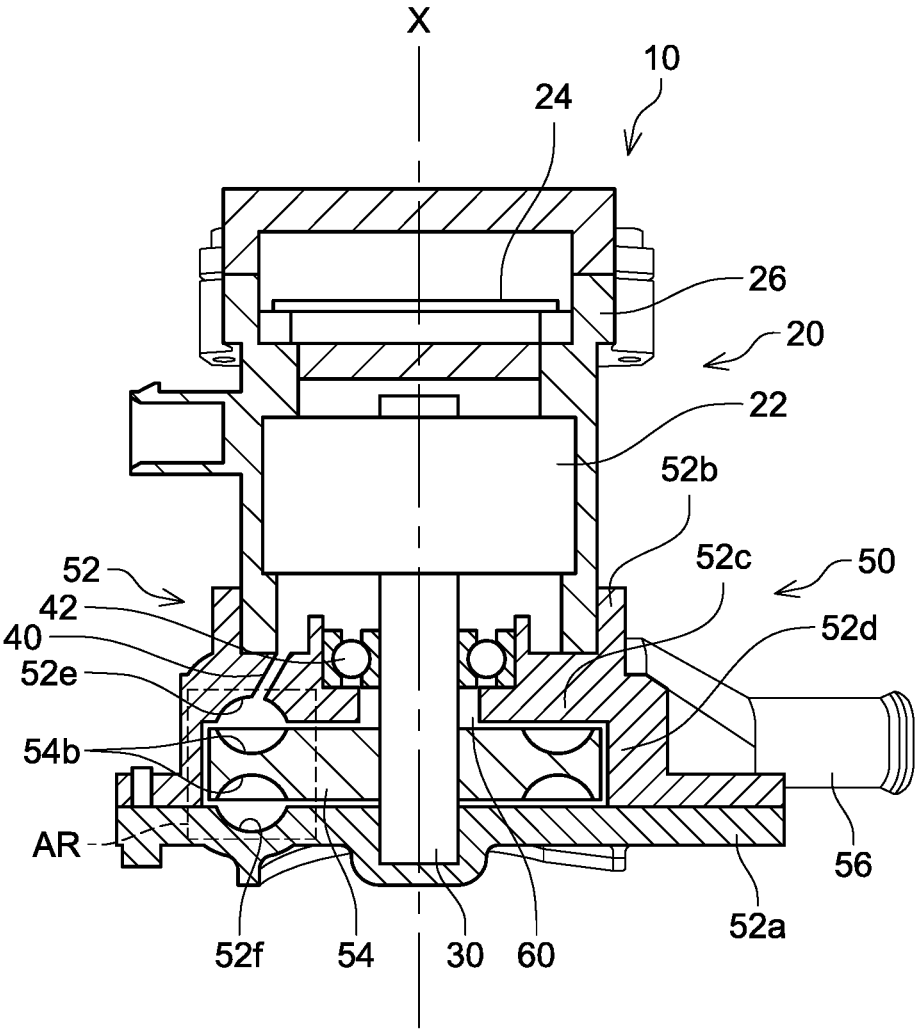
FIG. 4 shows a cross sectional view along a line IV-IV of FIG. 3.

Next, a configuration of the purge pump 10 will be described with reference to FIGS. 3 and 4. FIG. 3 is a perspective view that sees the purge pump 10 from a pump portion 50 side. FIG. 4 is a cross sectional view showing an IV-IV cross section in FIG. 3. In the present embodiment, "up" and "down" will be expressed with an up and down direction in FIG. 4 as a reference, however, the up and down direction in FIG. 4 may not be a direction along which the purge pump 10 is installed in a vehicle.

The purge pump 10 is provided with a housing (upper housing 26 and a lower housing 52), a motor portion 20, and a pump portion 50. The motor portion 20 includes the upper housing 26, a motor 22, and a control circuit 24. The motor 22 is for example a brushless motor. The upper housing 26 houses the motor 22 and the control circuit 24. The control circuit 24 converts DC power supplied from a battery of the vehicle to three-phase AC power having U, V, and W phases, and supplies the same to the motor 22. The control circuit 24 supplies power to the motor 22 according to signals supplied from the ECU 6. The motor 22 includes a cylindrical stator (not shown) and a rotor (not shown) arranged at a center of the stator. The rotor is fixed to an output shaft 30 of the motor 22. The output shaft 30 rotates about a rotation axis X.

The pump portion 50 is arranged under the motor portion 20. The pump portion 50 is driven by the motor 22. The pump portion 50 includes the lower housing 52 and an impeller 54. The output shaft 30 is connected to the impeller 54, and the impeller 54 rotates accompanying rotation of the output shaft 30. The impeller 54 is housed in the lower housing 52. The lower housing 52 is fixed to a lower end of the upper housing 26. The lower housing 52 includes a bottom wall 52*a* and a cover 52*b*. The cover 52*b* includes a top wall 52*c*, a peripheral wall 52*d*, a suction port 56, and a discharge port 58 (see FIG. 3). A bearing 42 is fixed to the lower housing 52. More specifically, the bearing 42 is press-fitted into a through hole provided at a center of the top wall 52*c*. The bearing 42 supports the output shaft 30 in a rotatable manner.

The top wall 52*c* is arranged at the lower end of the upper housing 26. The top wall 52*c* separates the motor portion 20 and the pump portion 50. More specifically, the top wall 52*c* separates a space where the motor 22 is arranged and a space where the impeller 54 is arranged. A communication hole 40 communicating the space where the motor 22 is arranged and the space where the impeller 54 is arranged is provided at a part of the top wall 52*c*. The communication hole 40 extends from a bottom of a facing groove 52*e* toward the motor portion 20. An opening of the communication hole 40 on an impeller 54 side is positioned radially outside than an opening of the communication hole 40 on a motor 22 side (where a radial direction refers to a direction orthogonally intersecting the rotation axis X). Details of the facing groove 52*e* and the communication hole 40 will be described later. Notably, the top wall 52*c* is an example of a separation wall as recited in the Claims.

The peripheral wall 52*d* protrudes downward from the top wall 52*c*, and surrounds an outer periphery of the top wall 52*c*. The bottom wall 52*a* is arranged at a lower end of the peripheral wall 52*d*. The bottom wall 52*a* is fixed to the cover 52*b* by bolts (not shown). The bottom wall 52*a* closes the lower end of the peripheral wall 52*d*. A space 60 is defined by the bottom wall 52*a* and the cover 52*b*. The impeller 54 is arranged in the space 60. A region AR will be described later.

Figure 5:
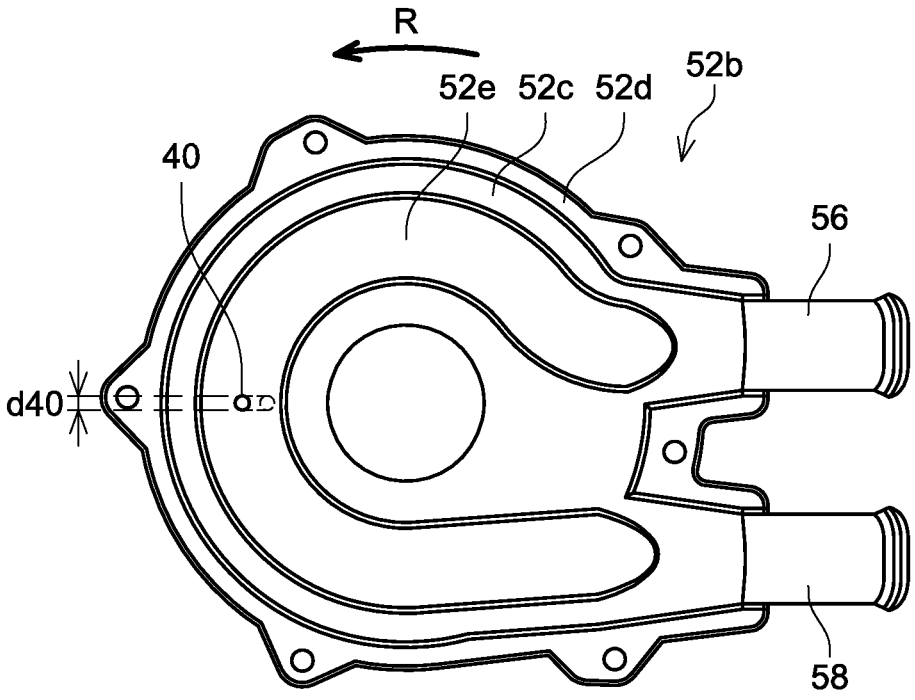
FIG. 5 shows a bottom surface of a cover as seen from below.

A passage in the purge pump 10 will be described with reference to FIG. 5. FIG. 5 is a diagram that sees the cover 52*b* from a lower side (from a side where the impeller 54 is to be arranged). An arrow R shows a moving direction of the purge gas during a pump operation. That is, the arrow R indicates a rotation direction of the impeller 54. The suction port 56 and the discharge port 58 are provided on the peripheral wall 52*d*. The suction port 56 and the discharge port 58 are each communicated with the space 60, and protrude outward from the peripheral wall 52*d*. The suction port 56 and the discharge port 58 are arranged parallel to each other, and vertically relative to the up and down direction. The suction port 56 communicates with the canister 73 through the communicating pipe 74 (see FIGS. 1 and 2 also). The suction port 56 includes a suction passage therein, and introduces the purge gas from the canister 73 into the space 60. The discharge port 58 includes a discharge passage therein, communicates with the suction port 56, and sends the purge gas sucked inside the space 60 to the outside of the purge pump 10 (communicating pipe 76).

The top wall 52*c* includes the facing groove 52*e* extending from the suction port 56 to the discharge port 58 along the peripheral wall 52*d*. The bottom wall 52*a* similarly includes a facing groove 52*f* extending from the suction port 56 to the discharge port 58 along the peripheral wall 52*d* (see FIG. 4). The facing groove 52*e* and the facing groove 52*f* each have a constant depth at their intermediate positions excluding both ends in a longitudinal direction, more specifically, at their positions facing the impeller 54, and become gradually shallower at their both ends in the longitudinal direction as they approach to the suction port 56 and the discharge port 58, respectively. The communication hole 40 is provided at a center of the facing groove 52*e* in the longitudinal direction (moving direction of the purge gas). A cross section of the communication hole 40 is circular, and a diameter d40 of the cross section is larger than a size of the apertures (aperture size) of the filter 73*g* (see FIG. 2) as aforementioned.

Figure 6:
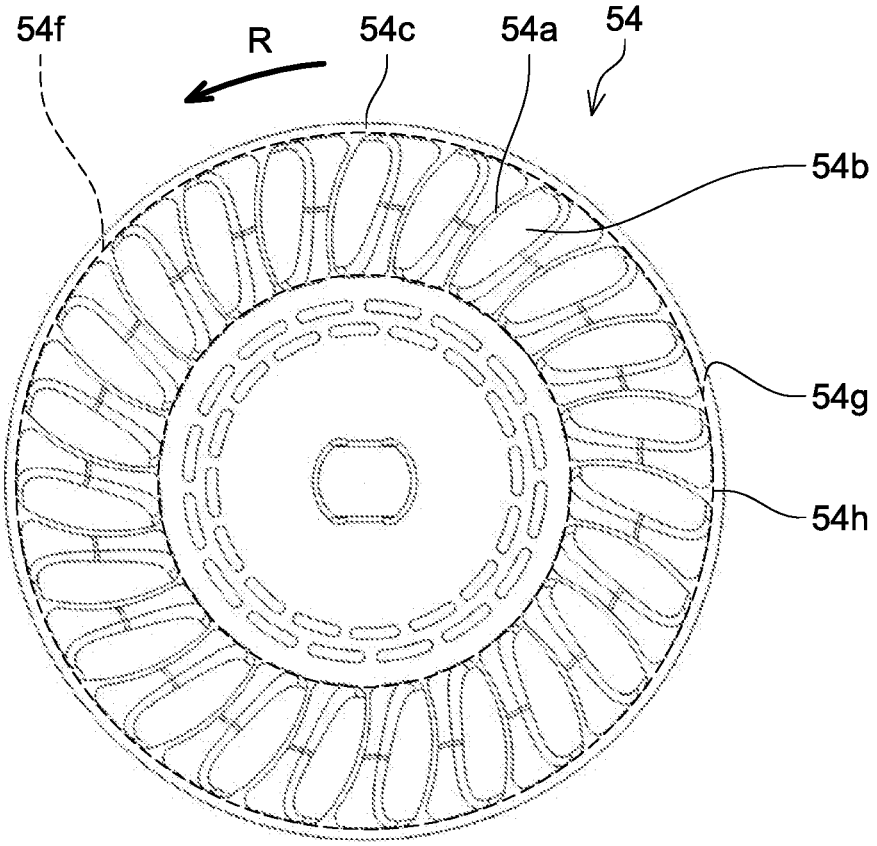
FIG. 6 shows a bottom surface of an impeller.

The impeller 54 will be described with reference to FIGS. 4, 6, and 7. As shown in FIG. 4, the space 60 houses the impeller 54. The impeller 54 has a circular disk shape (see FIG. 6). A thickness of the impeller 54 is somewhat smaller than a space between the top wall 52*c* and the bottom wall 52*a* of the lower housing 52. The impeller 54 faces each of the top wall 52*c* and the bottom wall 52*a* with a small space therebetween. Further, a small space is provided between the impeller 54 and the peripheral wall 52*d*. The impeller 54 includes a fitting hole (not shown) at its center for fitting the output shaft 30 therein. Due to this, the impeller 54 rotates about the rotation axis X accompanying the rotation of the output shaft 30.

The impeller 54 includes a vane-groove region 54*f* including a plurality of vanes 54*a* and a plurality of vane grooves 54*b* on an outer periphery of its lower surface 54*h*. It should be noted that, in FIG. 6, reference signs are given only to one vane 54*a* and one vane groove 54*b*. Similarly, the impeller 54 includes another vane-groove region 54*f* including a plurality of vanes 54*a* and a plurality of vane grooves 54*b* on an outer periphery of its upper surface 54*g*. Notably, the upper surface 54*g* and the lower surface 54*h* can be said as end surfaces of the impeller 54 in a rotation axis X direction. The vane-groove region 54*f* on the upper surface 54*g* is arranged to face the facing groove 52*e*. Similarly, the vane-groove region 54*f* on the lower surface 54*h* is arranged to face the facing groove 52*f*.

Each of the vane-groove regions 54*f* is arranged in a ring shape along a circumferential direction of the impeller 54 on an inner side of an outer peripheral wall 54*c* of the impeller 54. The plurality of vanes 54*a* has an identical shape. The plurality of vanes 54*a* is arranged at regular intervals in the vane-groove region 54*f* along the circumferential direction of the impeller 54. One vane groove 54*b* is arranged between each pair of vanes 54*a* being adjacent to each other in the circumferential direction of the impeller 54. That is, the plurality of vane grooves 54*b* is arranged at regular intervals along the circumferential direction of the impeller 54 on the inner side of the outer peripheral wall 54*c* of the impeller 54. Each of the plurality of vane grooves 54*b* has its outer circumferential end portion closed by the outer peripheral wall 54*c*. The plurality of vane grooves 54*b* has an identical shape.

Figure 7:
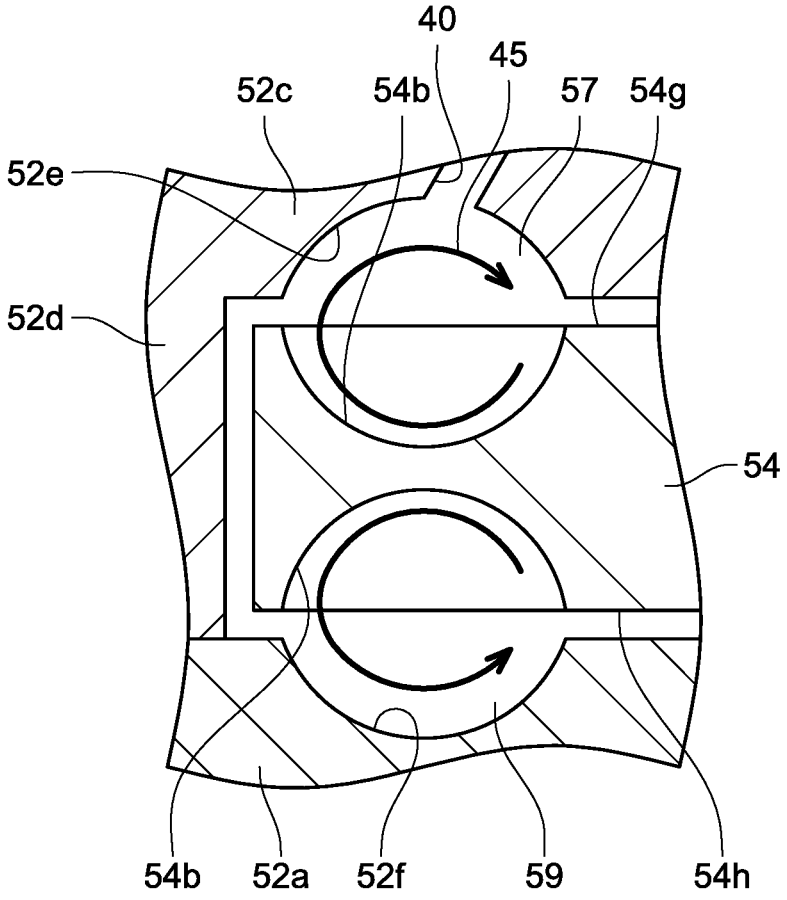
FIG. 7 shows an enlarged view of a region AR in FIG. 4.

FIG. 7 is an enlarged view of the region AR in FIG. 4. As is apparent from FIGS. 6 and 7, the plurality of vane grooves 54*b* arranged on the lower surface 54*h* of the impeller 54 respectively opens toward a lower surface 54*h* side of the impeller 54, whereas they are closed on an upper surface 54*g* side of the impeller 54. Similarly, the plurality of vane grooves 54*b* arranged on the upper surface 54*g* of the impeller 54 respectively opens toward the upper surface 54*g* side of the impeller 54, whereas they are closed on the lower surface 54*h* side of the impeller 54. That is, the plurality of vane grooves 54*b* arranged on the lower surface 54*h* of the impeller 54 and the plurality of vane grooves 54*b* arranged on the upper surface 54*g* of the impeller 54 are disconnected, and thus are not communicating.

During when the purge pump 10 is operating, the impeller 54 rotates accompanying rotation of the rotor in the motor portion 20. As a result, gas containing the fuel vapor absorbed in the canister 73 (purge gas) is sucked in from the suction port 56 into the lower housing 52. The purge gas that had flown into the lower housing 52 proceeds along the rotation direction R accompanying the rotation of the impeller 54 (see FIGS. 5 and 6). A rotating flow (swirling flow) of the gas is generated in a space 57 defined by the vane grooves 54*b* and the facing groove 52*e*. On the upper surface 54*g* side of the impeller 54, as shown by an arrow 45, the rotating flow flows toward an outer peripheral side of the impeller 54 along bottoms of the vane grooves 54*b*, and flows toward the center of the impeller 54 along a bottom of the facing groove 52*e*. Similarly, a rotation flow is generated in a space 59 defined by the vane grooves 54*b* and the facing groove 52*f*. The purge gas progresses in the rotation direction R while being pressurized by the rotating flow. The purge gas that has reached the end of the discharge port 58 is discharged from the discharge port 58.

An advantage of the purge pump 10 will be described. During when the purge pump 10 is operating, a pressure inside the pump portion 50 becomes higher than a pressure inside the motor portion 20. Due to this, the gas (purge gas) inside the pump portion 50 moves to the motor portion 20 through the communication hole 40. As aforementioned, the rotating flow flows along the bottom of the facing groove 52*e* from the outer peripheral side of the impeller 54 toward the center thereof. Further, the communication hole 40 extends from the bottom of the facing groove 52*e* toward the motor portion 20 as well as from the outer peripheral side of the impeller 54 toward the center thereof. That is, the communication hole 40 is inclined to extend along the rotating flow. When the communication hole 40 is inclined to extend along the rotating flow, the purge gas in the pump portion 50 can more easily move to the motor portion 20 therethrough, and the purge gas can be suppressed from moving to the motor portion 20 by passing through gaps in the bearing 42. With the communication hole 40 extending in a direction that is along the rotating flow, deterioration of the bearing 42 can be suppressed.

Notably, for example, if a communication hole extends along the rotation axis X from the bottom of the facing groove 52*e* toward the motor portion 20, the purge gas cannot move smoothly into the communication hole by an influence of the rotating flow. In such a case, the purge gas moves to the motor portion 20 by passing through other gaps (that is, the gaps in the bearing 42), which enhances the deterioration of the bearing 42.

Another advantage of the purge pump 10 will be described. As aforementioned, the diameter d40 of the communication hole 40 is larger than the apertures of the filter 73*g*. Due to this, foreign particles that had passed through the filter 73*g* can be prevented from clogging the communication hole 40. Clogging of the communication hole 40 can be prevented, and the purge gas can be prevented from passing through the gaps in the bearing 42. Notably, the shape (cross sectional shape) of the communication hole 40 may not be circular. For example, the cross-sectional shape of the communication hole 40 may be rectangular. In this case as well, the clogging of the communication hole 40 can be prevented by making the size of the communication hole 40 be larger than the size of the apertures of the filter 73*g*. Notably, if the cross-sectional shape of the communication hole 40 is rectangular, a length of its short side corresponds to the size of the communication hole 40.

As aforementioned, the communication hole 40 is provided at the center of the facing groove 52*e* in the longitudinal direction. With a vortex pump, the pressure in the pump portion 50 is higher on a discharge port 58 side than on a suction port 56 side. Due to this, depending on a position where the communication hole 40 is to be provided, the purge gas that had moved from the pump portion 50 to the motor portion 20 through the communication hole 40 may move back from the motor portion 20 to the pump portion 50 through the gaps in the bearing 42. In another case, the purge gas may move from the pump portion 50 to the motor portion 20 through the gaps in the bearing 42, and may move back from the motor portion 20 to the pump portion 50 through the communication hole 40. The pressure at the center of the facing groove 52*e* in the longitudinal direction is an average pressure within the pump portion 50, and it is substantially equal to a pressure applied to the bearing 42. By providing the communication hole 40 at such a position, the purge gas can surely be prevented from passing through the gaps in the bearing 42. Notably, when a distance from an end of the facing groove 52*e* on the suction port 56 side to an end thereof on the discharge port 58 side is denoted as being 100, the communication hole 40 may be provided at a position within a range of 25 to 75, which starts from the end of the facing groove 52*e* on the suction port 56 side. Force within this range substantially corresponds to the average pressure in the pump portion 50. Due to this, similar effects as in the embodiment that provides the communication hole 40 at the center in the longitudinal direction can be achieved.

Figure 8:
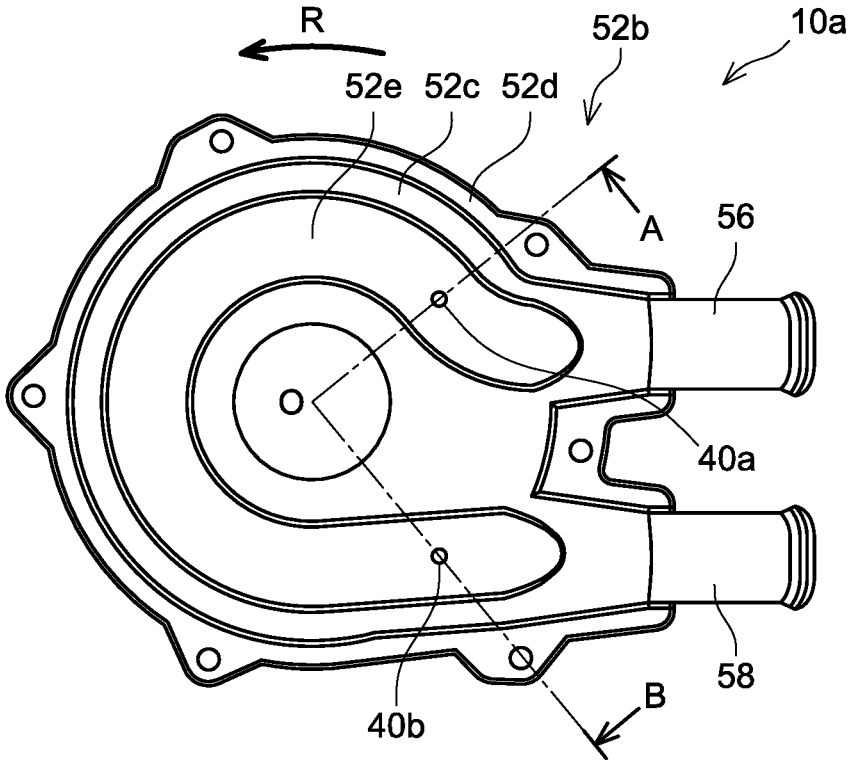
FIG. 8 shows a bottom surface of a cover of a purge pump of a variant, as seen from below.
Figure 9:
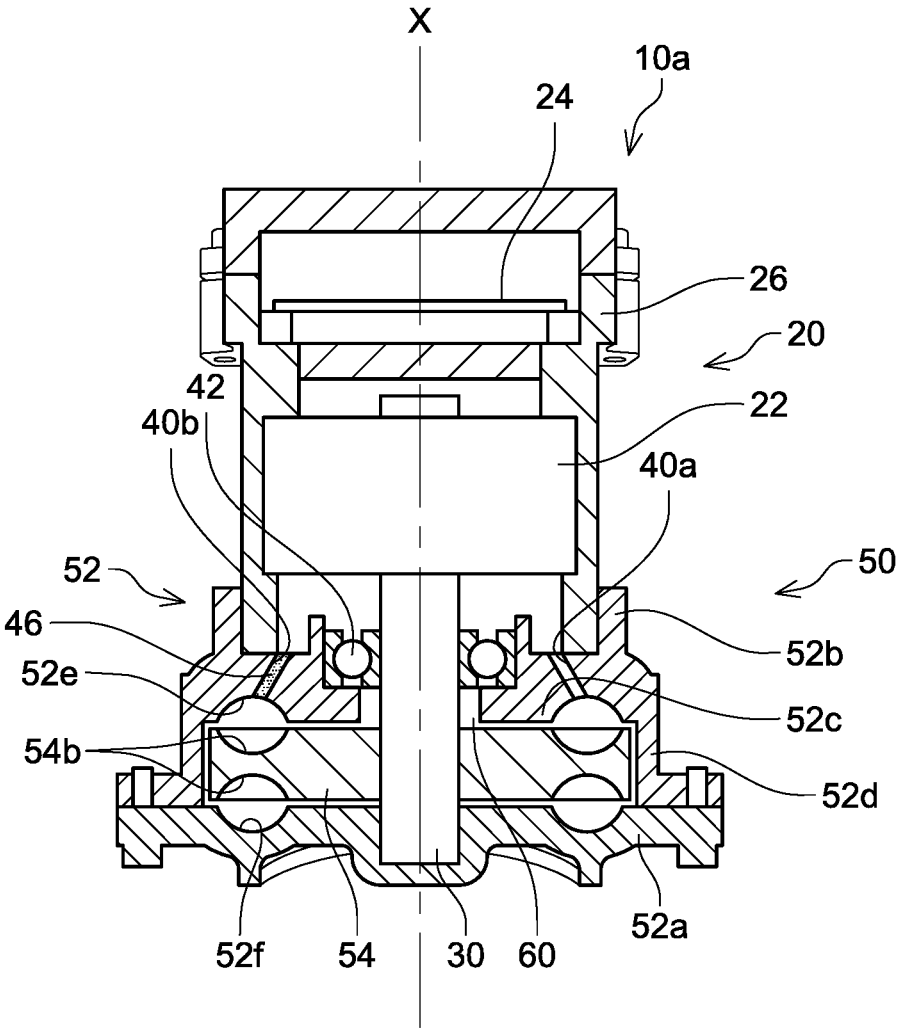
FIG. 9 shows a cross sectional view along a line segment A-O-B of FIG. 8.

A purge pump 10*a* will be described with reference to FIGS. 8 and 9. The purge pump 10*a* is a variant of the purge pump 10, and positions where communication holes are provided are different from the purge pump 10. In the purge pump 10*a*, configurations that are same as those of the purge pump 10 are given the same reference signs, and descriptions thereof may be omitted. Notably, the purge pump 10*a* may be used in the fuel vapor treatment device 9 of the fuel supply system 1 as a substitute of the purge pump 10 (see FIGS. 1 and 2 as well).

The purge pump 10*a* includes two communication holes 40*a*, 40*b*. The communication hole 40*a* is provided on the suction port 56 side from the center of the facing groove 52*e*. The communication hole 40*b* is provided on the discharge port 58 from the center of the facing groove 52*e*. As aforementioned, with a vortex pump, the pressure in the pump portion 50 is higher on the discharge port 58 side than on the suction port 56 side. Due to this, by providing the communication holes (communication holes 40*a*, 40*b*) on both of the suction port 56 side and the discharge port 58 side, a flow in which the purge gas moves from the pump portion 50 to the motor portion 20 through the communication hole 40*b*, and moves back from the motor portion 20 to the pump portion 50 through the communication hole 40*a* is formed. The purge gas can more surely be prevented from passing through the gaps in the bearing 42.

In the above embodiment, the vortex pump in the embodiment in which the communication hole is provided at the center of the facing groove in the longitudinal direction (purge pump 10), and the vortex pump in the embodiment in which two communication holes are provided respectively on the suction port side and the discharge port side of the facing groove (purge pump 10*a*) are described. However, position(s) where the communication hole(s) are to be provided, and a number of the communication hole(s) are not limited to the aforementioned embodiments. For example, a communication hole may be provided only on the suction port side or on the discharge port side of the facing groove, and alternatively, three or more communication holes may be provided.

Further, in the above embodiment (purge pump 10*a*), the vortex pump in the embodiment in which filters are provided on the communication holes is described. However, the filter is not an essential constituent feature of the vortex pump, and it may be omitted as needed. Essences of the technique disclosed herein lies in that a groove is provided on a separation wall that separates a motor portion and a pump portion (a facing groove facing vane grooves of an impeller), a communication hole communicating the motor portion and the pump portion is provided at a bottom of the groove, and the communication hole extends inclined relative to a rotation shaft of the impeller so as to extend along a rotating flow (swirling flow) formed by the vane grooves and the facing groove.

While specific examples of the present invention have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

What is claimed is:

1. A vortex pump comprising a housing, wherein the housing comprises:

a motor portion comprising a motor;

a pump portion comprising a fluid suction port, a fluid discharge port, and an impeller configured to rotate together with an output shaft of the motor; and a separation wall comprising a bearing fixed to the separation wall and separating the motor portion and the pump portion, the bearing supporting the output shaft;

wherein the impeller comprises a vane-groove region at an outer periphery of a surface of the impeller facing the separation wall along a rotation direction in which the impeller rotates, the vane-groove region including a plurality of vanes and a plurality of vane grooves, each of which is disposed between the adjacent vanes, and the separation wall comprises a facing groove facing the vane-groove region, extending in the rotation direction of the impeller, and having a bottom provided with a communication hole for communicating the motor portion and the pump portion, and wherein the communication hole extends from a bottom of the facing groove toward the motor portion, the communication hole inclined to approach the output shaft of the motor.

2. The vortex pump according to claim 1, further comprising another communication hole for communicating the motor portion and the pump portion, wherein the communication hole is provided on a fluid suction port side and the other communication hole is provided on a fluid discharge port side.

3. The vortex pump according to claim 2, further comprising a filter provided on the other communication hole on the fluid discharge port side.

4. The vortex pump according to claim 1, wherein the communication hole is provided at a position where a pressure equivalent to a pressure applied to the bearing is applied when the vortex pump is operating.

5. A fuel vapor treatment device comprising:

a canister that absorbs fuel vapor generated in a fuel tank;

a purge passage connected between an intake passage of an internal combustion engine and the canister, and through which purge gas fed from the canister to the internal combustion engine passes; and a vortex pump according to claim 1 and provided on the purge passage between the canister and the intake passage, wherein a size of the communication hole provided in the vortex pump is larger than a size of apertures of a filter provided on the canister.

6. A vortex pump comprising a housing, wherein the housing comprises:

a motor portion comprising a motor;

a pump portion comprising a fluid suction port, a fluid discharge port, and an impeller configured to rotate together with an output shaft of the motor; and a separation wall comprising a bearing fixed to the separation wall and separating the motor portion and the pump portion, the bearing supporting the output shaft;

wherein the impeller faces the separation wall, and the separation wall comprises a communication hole for communicating the motor portion and the pump portion, the communication hole inclined to the output shaft of the motor.

* * * * *